US009604247B2

(12) United States Patent
Grinberg et al.

(10) Patent No.: US 9,604,247 B2
(45) Date of Patent: Mar. 28, 2017

(54) SYSTEM AND METHOD TO APPLY TOPPING MATERIALS TO PRINT PRODUCTS

(71) Applicant: SCODIX LTD., Pardesiya (IL)

(72) Inventors: Eli Grinberg, Pardesiya (IL); Eran Mutai, Modi'in (IL); Amir Osadon, Givatayim (IL)

(73) Assignee: SCODIX LTD., Pardesiya (IL)

( * ) Notice: Subject to any disclaimer, the term of this patent is extended or adjusted under 35 U.S.C. 154(b) by 270 days.

(21) Appl. No.: 14/387,275

(22) PCT Filed: Apr. 7, 2013

(86) PCT No.: PCT/IB2013/052772
§ 371 (c)(1),
(2) Date: Sep. 23, 2014

(87) PCT Pub. No.: WO2013/164715
PCT Pub. Date: Nov. 7, 2013

(65) Prior Publication Data

US 2015/0053131 A1 Feb. 26, 2015

Related U.S. Application Data

(60) Provisional application No. 61/640,772, filed on May 1, 2012.

(51) Int. Cl.
*B05C 19/04* (2006.01)
*B44F 1/02* (2006.01)
(Continued)

(52) U.S. Cl.
CPC ..... *B05C 19/04* (2013.01); *B05C 19/06* (2013.01); *B41F 16/00* (2013.01); *B41F 19/002* (2013.01);
(Continued)

(58) Field of Classification Search
None
See application file for complete search history.

(56) References Cited

U.S. PATENT DOCUMENTS 4,172,303 A * 10/1979 Wooding ..... G03G 21/0035 15/256.52
4,974,646 A * 12/1990 Martin ..... B65B 1/16 141/128
(Continued)

FOREIGN PATENT DOCUMENTS

CN 200939733 Y 8/2007
DE 29617541 U1 11/1996
(Continued)

OTHER PUBLICATIONS

International Search Report & Written Opinion in PCT/IB2013/052772 dated Sep. 1, 2013.
Written Opinion in EP 13784173.0 dated Oct. 19, 2015.

*Primary Examiner* — Charles Capozzi
(74) *Attorney, Agent, or Firm* — Manelli Selter PLLC; Edward J. Stemberger

(57) ABSTRACT

Disclosed are systems and methods, including a method that includes depositing a curable adhesive onto a first surface of a substrate in a pre-determined pattern, placing topping material onto the substrate with the deposited adhesive, and applying UV energy to the substrate including the deposited adhesive and the placed topping material to cause curing of the deposited adhesive.

2 Claims, 6 Drawing Sheets

(51) Int. Cl.

| | |
|---|---|
| ***B41F 19/00*** | (2006.01) |
| ***B41F 16/00*** | (2006.01) |
| ***B05C 19/06*** | (2006.01) |
| *B05D 5/06* | (2006.01) |

(52) U.S. Cl.
CPC ..... *B41F 19/004* (2013.01); *B44F 1/02* (2013.01); *B05D 5/061* (2013.01); *B05D 2451/00* (2013.01)

(56) References Cited

U.S. PATENT DOCUMENTS

| | | | | |
|---|---|---|---|---|
| 5,146,868 | A * | 9/1992 | Kirk | B41G 1/00 118/309 |
| 5,436,713 | A * | 7/1995 | Bigelow | G03G 21/0035 399/353 |
| 5,943,722 | A | 8/1999 | Hamilton | |
| 2008/0156421 | A1 | 7/2008 | Lee et al. | |

FOREIGN PATENT DOCUMENTS

| | | |
|---|---|---|
| EP | 0657309 | 6/1995 |
| GB | 2289866 A | 12/1995 |
| WO | 9965699 | 12/1999 |
| WO | 2009040797 | 4/2009 |
| WO | 2011077200 | 6/2011 |
| WO | 2011110956 | 9/2011 |

* cited by examiner

SYSTEM AND METHOD TO APPLY TOPPING MATERIALS TO PRINT PRODUCTS

CROSS-REFERENCE TO RELATED PATENT APPLICATIONS

The present application claims benefit and priority to U.S. Provisional Patent Application No. 61/640,772, filed May 1, 2012, and entitled "SYSTEM AND METHOD TO APPLY TOPPING MATERIALS TO PRINT PRODUCTS," the content of which is hereby incorporated by reference in its entirety.

TECHNOLOGY FIELD

The present disclosure is directed to producing print products (e.g., cards, printed literature, etc.), and more particularly to a system and method to apply topping materials, for example, glitter materials, to print products.

BACKGROUND

Glitter, metallic and glass powders that reflect light are widely used for decorative applications such as posters, birthday cards and the like. Conventionally, a self-drying, water based, plastic adhesive is silk screened or rolled onto a substrate, glitter powder is poured, and the substrate is then tipped and shaken and/or vacuumed to remove excess glitter. Such techniques tend to result in low resolution print products.

SUMMARY

According to a first aspect of the present invention there is provided a system comprising: an adhesive depositing machine configured to deposit a curable adhesive onto a first surface of a substrate in a pre-determined pattern; a placement device configured to place topping material onto the substrate with the deposited adhesive; a UV energy source configured to apply UV energy to the substrate including the deposited adhesive and the placed topping material to cause curing of the deposited adhesive; and a topping material removal unit configured to remove excess topping material not adhered to the deposited adhesive, said removal unit comprising: a plurality of wheels mounted on a shaft, each wheel comprising thin needles attached to its circumference, said wheels configured to collect excess topping material from the substrate; a brush spanning the wheels shaft and configured to brush topping material from the needles; and a vacuum system mounted above said wheels, said vacuum system configured to suck topping material from said needles and transfer it to said placement device.

The placement device may comprise a funnel shaped receptacle configured to receive and dispense topping material, said receptacle comprising an inner perforated partition spanning the height of the receptacle, wherein said receptacle is configured to vibrate, whereby the topping material is shattered between said receptacle walls and said partition.

The system may additionally comprise a cleaning station downstream said vacuum system, said cleaning station configured to remove non-adhered topping material from the substrate, said cleaning station comprising: a first wheel mounted underneath the substrate and configured to rotate in a first direction coinciding with the direction of movement of the substrate; a second wheel mounted above the substrate and configured to rotate in a direction opposite said first direction, said second wheel having a sticky surface configured to collect residual topping material from said substrate; and a third wheel mounted above said second wheel and configured to rotate in said first direction, said third wheel having a surface stickier than said second wheel surface and configured to collect topping material from said second wheel surface, wherein said third wheel surface is peelable.

According to a second aspect of the present invention there is provided a device for placing topping material onto a substrate, comprising a funnel shaped receptacle configured to receive and dispense topping material, said receptacle comprising an inner perforated partition spanning the height of the receptacle, said receptacle configured to vibrate, whereby the topping material is shattered between said receptacle walls and said partition.

According to a third aspect of the present invention there is provided a cleaning station for removing non-adhered topping material from a moving substrate, comprising: a first wheel mounted underneath the substrate and configured to rotate in a first direction coinciding with the direction of movement of the substrate; a second wheel mounted above the substrate and configured to rotate in a direction opposite said first direction, said second wheel having a sticky surface configured to collect residual topping material from said substrate; and a third wheel mounted above said second wheel and configured to rotate in said first direction, said third wheel having a surface stickier than said second wheel surface and configured to collect topping material from said second wheel surface, wherein said third wheel surface is peelable.

BRIEF DESCRIPTION OF THE DRAWINGS

These and other aspects will now be described in detail with reference to the following drawings.

Like reference symbols in the various drawings indicate like elements.

DETAILED DESCRIPTION

Disclosed are systems, machines, devices and methods, including a method for depositing a curable adhesive onto a first surface of a substrate in a pre-determined pattern, placing topping material onto the substrate with the deposited adhesive, and applying UV energy to the substrate including the deposited adhesive and the placed topping material to cause curing of the deposited adhesive. In some embodiments, to further harden the adhesive, other types of energy, including infrared energy (from the same source producing the UV energy or a different source) may be used.

Also disclosed is a system that includes an adhesive depositing machine to deposit a curable adhesive onto a first surface of a substrate in a pre-determined pattern, a placement device to place topping material onto the substrate with the deposited adhesive, and a UV energy source (which may include, for example, a UV fluorescent lamp, a UV LED device, a UV laser device, a gas-discharge lamp, etc.) to apply UV energy to the substrate including the deposited adhesive and the placed topping material to cause curing of the deposited adhesive.

As used herein, the term 'Inkjet Printing' or 'Inkjetting' refers hereinafter to an adaptation of the conventional technology developed for the deposition of ink onto paper, including: thermal inkjets, piezoelectric inkjets and continuous inkjets, as a mechanism for the deposition of various materials in liquid form, including adhesive, onto a substrate. An inkjet can include, for example, a conventional an inkjet printer, a toner-based printer, a silk screen printer and/or a lithography-based printer.

The term 'nipping' refers hereinafter to the action of tightly holding or squeezing at least two items together.

The term 'curing' refers hereinafter to the toughening or hardening of a polymer material by cross-linking of polymer chains, brought about by procedures that include, for example, procedures based on use of chemical additives, ultraviolet radiation, electron beam (EB), heat, etc.

Figure 1:
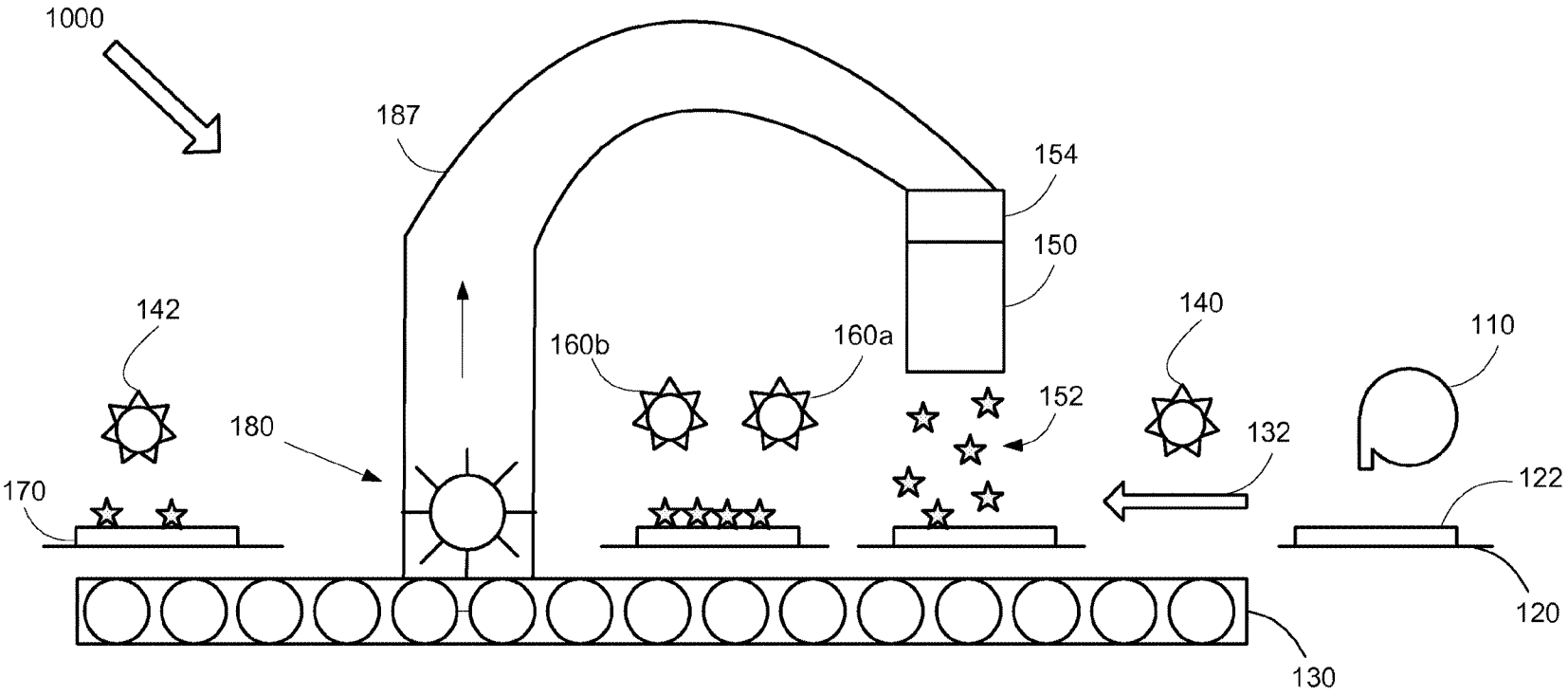
FIG. 1 is a schematic diagram of an example system to produce print products with improved vacuum suction system.

With reference to FIG. 1, a schematic diagram of system 1000 to produce print products, including print product to which topping materials (such as glitter) are added is shown. The system 100 includes an adhesive depositing section 110 which may include, in some implementations, a digital printing device 110 (e.g., an inkjet printer) to digitally deposit is some pre-determined pattern deposit material composed of a layer of adhesive 122, generally having a thickness of about 1 to 200 microns, onto a first (e.g., top) surface of a substrate 120. Other types of depositing printing devices that may be used include, for example, a toner-based printer, a silk screen printer, a lithography-based printer, etc. When deposited on the substrate 120, the adhesive layer 122 may be tacky or non-tacky. A conveyer belt 130 advances the adhesive-topped substrate (which, as noted, may be patterned) in a direction indicated by an arrow 132.

In some embodiments, the adhesive may include a radical type adhesive, a cationic adhesive, etc. Such adhesives may include, for example, photo polymeric adhesives. Further details about procedures to deposit/print adhesives are provided in, for example, U.S. patent application Ser. No. 12/721,234, entitled "A System and Method for Cold Foil Relief Production," the content of which is hereby incorporated by reference in its entirety.

The substrate 120 may be constructed from a material composition including, for example, metal, plastic, paper, glass, non-woven fabric, methacrylic copolymer resin, polyester, polycarbonate and polyvinyl chloride, plastic, paper, glass, non-woven fabric, methacrylic copolymer resin, polyester, polycarbonate, polyvinyl chloride, etc. The substrate 120 may be in sheet form or roll form and may be rigid or flexible.

In some embodiments, the structure comprising the substrate 120 and the curable adhesive 122 may be exposed to energy applied from a first, optional, energy source 140 located upstream of a placement device to add the topping material to the substrate with the deposited adhesive, thus initiating the curing of the adhesive 122 and manipulating (regulating) the adhesive's viscosity. The pre-curing process, which may be controlled by the composition of the adhesive, the energy source used, and the manner in which energy is applied, may initiate the curing process. During the curing process, the adhesive may or may not become tacky. After adding a topping material, such as glitter, the adhesive is cured to cause it to become substantially tacky and thus to cause added materials, such as glitter to substantially adhere to the deposited adhesive.

In some embodiments, the adhesive has an initial viscosity of 10 cps (centipoise). In some embodiments, the energy source 140 may be a radiation source, such as a ultraviolet source, emitting UV radiation onto the curable adhesive 122 to initiate the curing process. Examples of UV radiation sources that may be used as the UV energy source 140, or as any of the UV sources of the system 1000, 2000 and 3000 described herein, include, for example a UV fluorescent lamp, a UV LED device, a UV laser device, etc. Partial curing performed on the adhesive, e.g., to initiate the curing, causes the polymerization of the material to start so that the adhesive starts to change its phase from liquid to solid. In some embodiments, the energy source 140 may be, for example, an infrared source, a lamp generating incoherent optical radiation, a laser source, a gas-discharge lamp, an electron beam generator, a heating element, etc. Other types of energy sources may be used.

The structure including the adhesive-topped substrate (with or without having the adhesive 122 exposed to the upstream energy source 140 to initiate the curing process) advances to a placement/topping station in which topping material, such as glitter, some other metallic-based material, etc., is placed onto the substrate with the curable adhesive. In some embodiments, the placement station may include a placement device 150 (which may be a sprinkling device, a spraying device, a jetting device, etc.) that sprinkles (or pours, or otherwise disposes) topping material 152, such as glitter, onto the substrate on which an adhesive was deposited in some pre-determined pattern. The topping material may be stored in a topping material source/reservoir 154. When the topping material is placed on the adhesive, it may start to adhere to the adhesive deposited on the substrate (depending on the adhesive's level of adhesiveness and how tacky the adhesive is).

In some embodiments, the placed particles of the topping material may be placed with sufficient energy so that at least a portion of the topping material's particles can penetrate the deposited adhesive/glue layer and be embedded therein. The energy of the placed particles may be provided from their gravitational fall towards the substrate, or through an initial thrust given to the topping material by way of a sprinkling device, a spraying device, a jetting device, etc., to place the topping material on the substrate with the deposited adhesive.

In some embodiments, the topping material 152 may be provided in the form of powder, including colored powder that can adhere to the adhesive material once the adhesive material is cured. Thus, for example, to produce print products that include raised colored features (e.g., text), the adhesive is deposited to form a patterned adhesive layer of some pre-determined thickness (e.g., 120 micron), and color powder may then be sprinkled from a sprinkling device such as the placement device 150. Subsequently, the substrate with the colored raised features is subjected to energy from an energy source to cause curing and/or hardening of the adhesive.

With the placed glitter (or some other topping material) disposed on the substrate with the deposited curable adhesive, the substrate is advanced to a curing/heating station that may include one or more energy sources, such as the UV energy sources 160*a* and 160*b* to perform the curing process of the adhesive 122 (on which the topping material was placed). In the implementations depicted in FIG. 1 the one or more energy sources include two energy sources (e.g., arranged to define an array of energy sources) that may be arranged in configurations to enable particular energy distribution patterns.

Additionally or alternatively, one or more energy sources, such as UV energy source 142, may perform curing downstream the removal station 180.

During the curing process, the topping material adheres to the gradually hardening adhesive. As a result of the curing process, topping materials that were in contact with the pattern of deposited adhesive on the substrate will be substantially secured to the hardening adhesive, while topping materials that were spread over areas of the surface of the substrate that did not include an adhesive will not bind or otherwise become secured to the structure that includes the substrate and the patterned deposited adhesive. Consequently, by removing excess topping material from the substrate, generally only topping materials bound to the adhesive during the initial placement of the topping materials and the curing process will remain on the substrate, resulting in the print product 170. Removing excess topping materials, e.g., at a removal station 180, may be performed by one or more of, for example, a) vacuuming the excess topping material, b) tipping the substrate in order to cause at least some loose non-adhered topping material be removed, and c) tamping the substrate to cause excess topping material to be shaken off.

Figure 2:
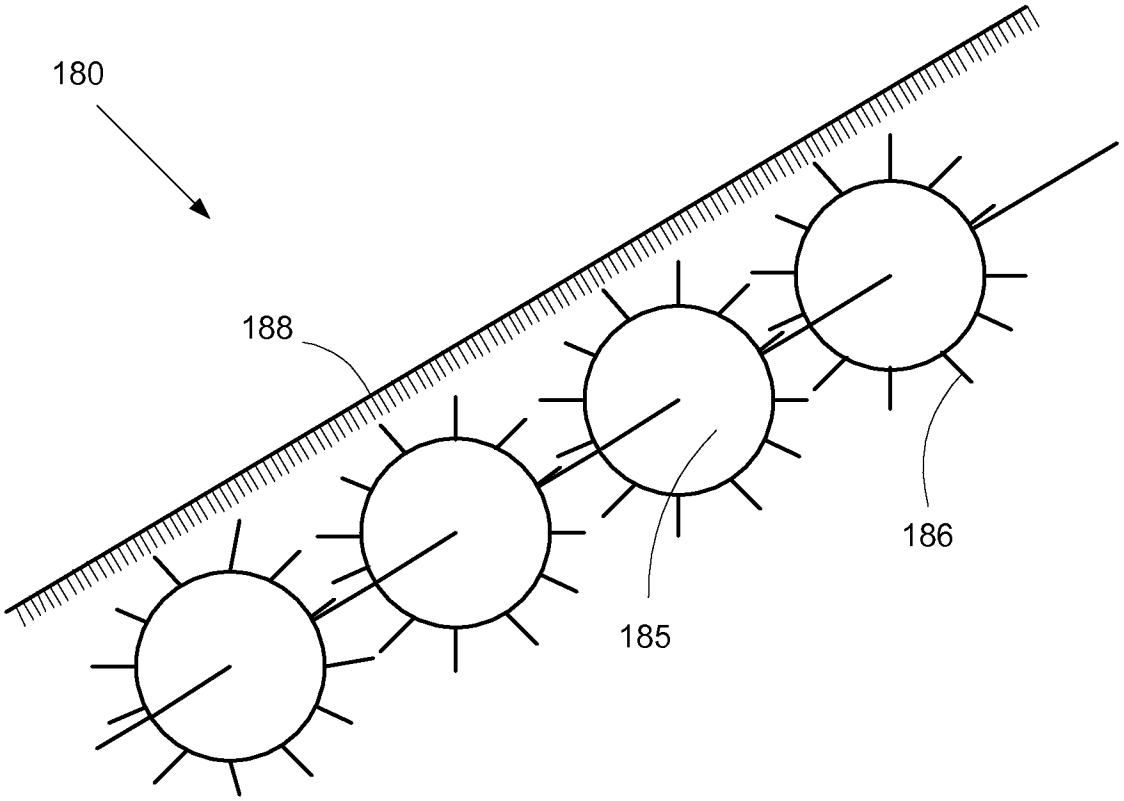
FIG. 2 is a schematic detailed diagram of the improvement according to FIG. 1.

In the embodiment of FIGS. 1 and 2, removal station 180 comprises wheels 185 to which thin needles 186 (e.g. having 0.6 mm diameter) are attached around the wheels' circumference. The wheels 185 rotate above the substrate, whereby the needles collect non-adhered topping material. The collected topping material is sucked by vacuum system 187 back into the dispenser 150. A brush 188 (FIG. 2) continuously brushes off adhesive and topping material stuck to the needles.

Further processing on the finished product 170 may be performed.

In some embodiments, removal of topping material particles, other contaminants (e.g., dust), etc., may be performed prior to one or more of the adhesive depositing stage, and/or the pre-curing stage. Thus, for example, prior to depositing curable adhesive (e.g., by a printing device), the substrate may undergo a procedure of removing/cleaning particles, including topping particles, contaminants, etc., by performing, for example vacuuming of the substrate, tipping the substrate to cause at least some loose particles to be removed, tamping the substrate to cause such particles to be removed, etc. As noted, similar particle removal procedures can also be performed prior to the pre-curing process (e.g., before topping material is placed on the substrate).

In some embodiments, the system 1000 may also include one or more other sources of energy, such as for example, infrared energy sources. In such embodiments, the substrate with the topping material disposed on the deposited adhesive is also subjected, in addition to UV energy that causes curing of the curable adhesive, to infrared radiation that heats the structure of the substrate, adhesive and topping material. This additional source of energy may expedite the hardening process, cause melting of the topping material, etc. Thus, for example, in some embodiments, the energy source 160*a* of FIG. 1 may be a UV energy source, whereas the energy source 160*b* may be an infrared source. In some embodiments, an energy source may produce radiation that includes a UV radiation component and an infrared radiation component (and/or additional radiation components) that are then directed to the substrate to facilitate the process of forming print products such as the print product 170.

Figure 3:
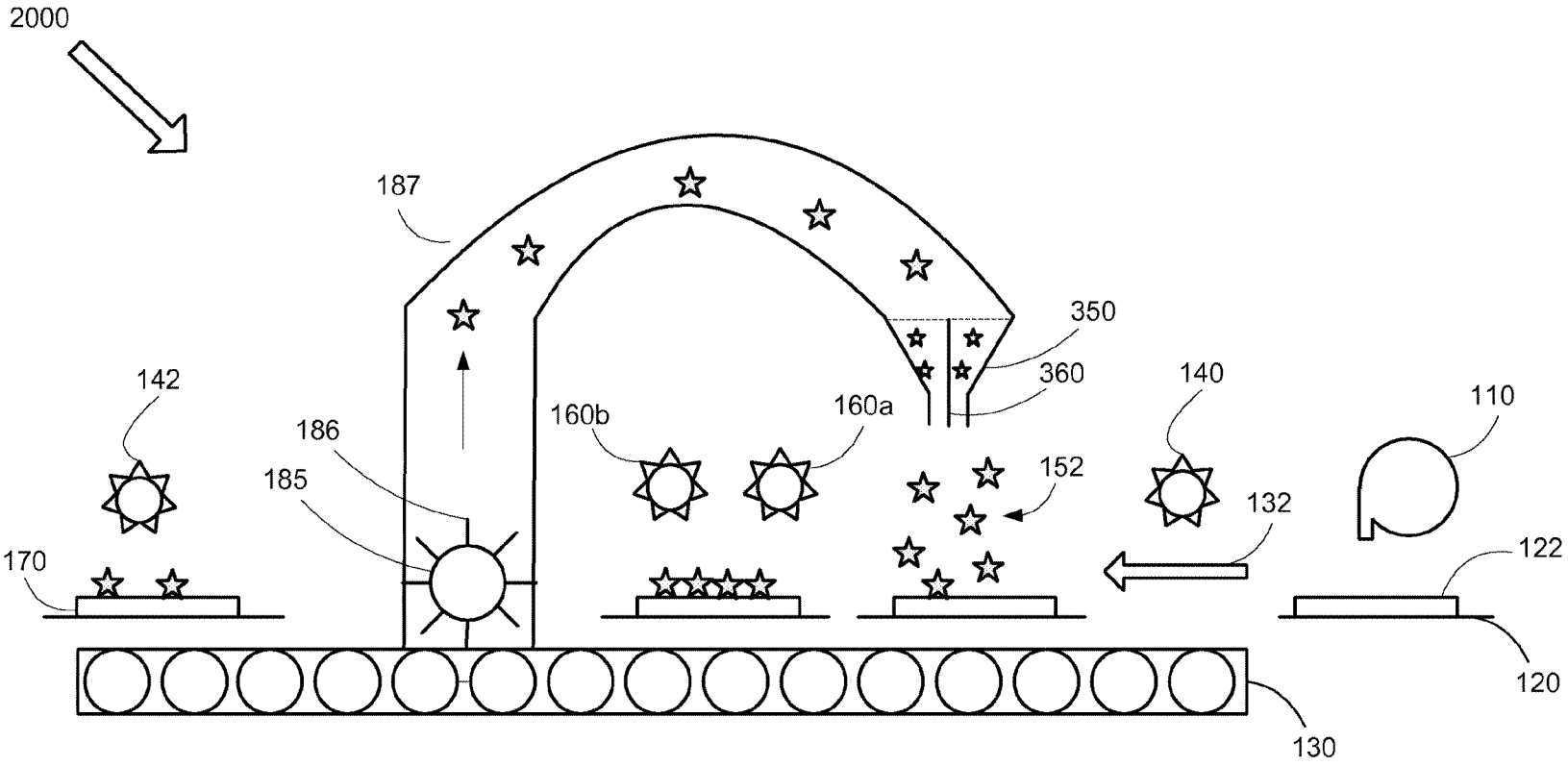
FIG. 3 is a schematic diagrams of additional systems to produce print products with an improved topping dispenser.

Referring now to FIG. 3, a schematic diagram of an example system 2000 is shown. The system 2000 is generally similar to the system 1000 depicted in FIG. 1, and is thus generally configured to perform similar operations to those performed by the system 1000.

Figure 4:
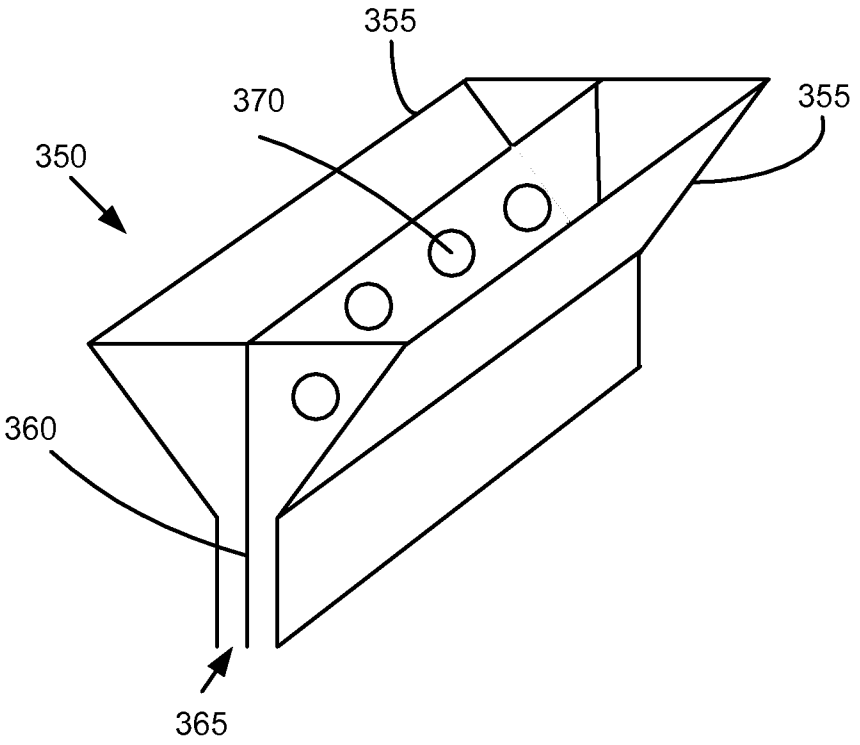
FIG. 4 is a schematic detailed diagram of the improvement according to FIG. 3.

In the embodiment of FIGS. 3 and 4, a new topping dispensing apparatus is disclosed. The topping dispensing apparatus 350 is a receptacle shaped as a funnel and comprises slanted outer walls 355 and an inner partition 360, preferably comprising holes 370 to enable particles movement between the two sides of the partition.

Topping dispensing apparatus 350 is connected to a motor (not shown) to induce vibrations to the topping dispensing apparatus, thereby facilitating the dispensing of topping material to the substrate underneath.

It has been found that when a relatively thick layer of adhesive 122 is applied to the substrate 120, a large amount of topping material dispensed from dispenser 350 may not be entirely disposed of by the end of the process, leaving non-adhered topping material on the substrate. Therefore, in order to reduce the amount of topping material dispensed, a narrower opening 365 has been designed, which caused topping material to block the opening. The solution found was to install a partition 360 that spans the height of dispenser 350. Partition 360 may be static, or vibrate in a different frequency than the vibration frequency of dispenser 350. The relative movement between dispenser 350 and partition 360 shatters the topping material into small particles which are able to fit through the narrow opening 360.

Figure 5:
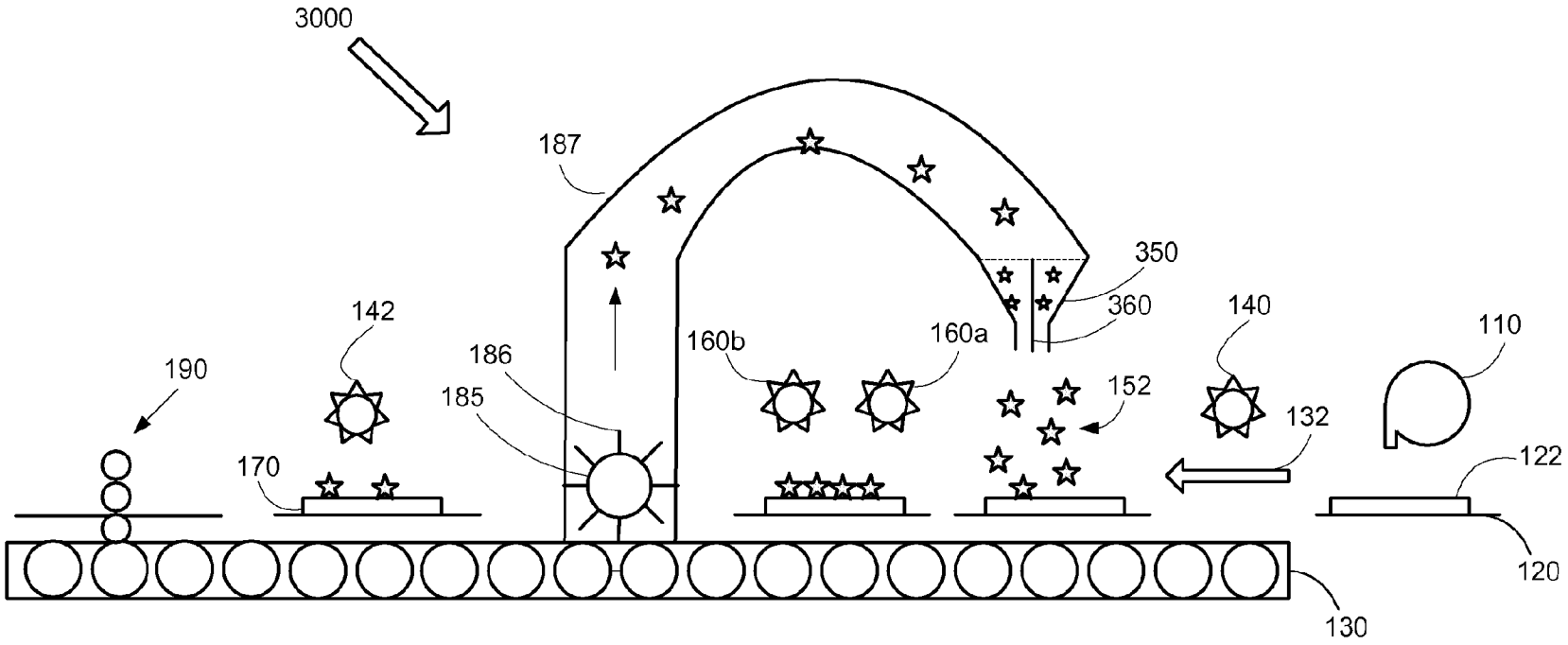
FIG. 5 is a schematic diagrams of additional systems to produce print products with an additional cleaning apparatus.

Referring now to FIG. 5, a schematic diagram of an example system 3000 is shown. The system 3000 is generally similar to the system 2000 depicted in FIG. 3, and is thus generally configured to perform similar operations to those performed by the system 2000.

Figure 6:
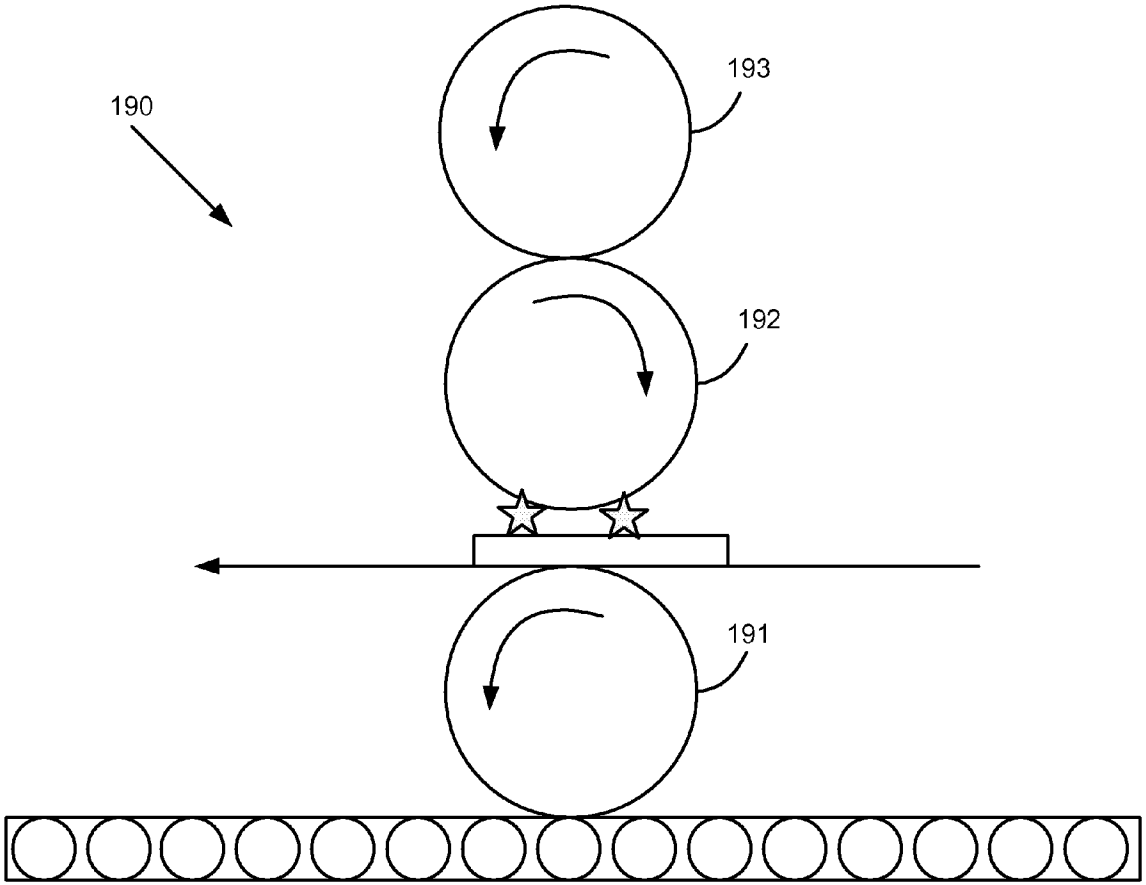
FIG. 6 is a schematic detailed diagram of the improvement according to FIG. 5.

In the embodiment of FIGS. 5 and 6, an additional substrate cleaning station 190 is installed downstream the curing station 142, to remove remaining non-adhered topping material.

Cleaning station 190 comprises a first wheel 191, in contact with conveyer belt 130, and rotating in a first direction, a second wheel 192 mounted above the substrate and rotating in a second direction opposite to the first direction and a third wheel 193 abutting wheel 192 and rotating in the first direction. Wheels 192 and 193 have sticky surfaces, where the surface of wheel 193 is stickier than the surface of wheel 192. In operation, topping material collected by wheel 192 is therefore removed by wheel 193, leaving wheel 192 free to collect further topping material from the substrate. Wheel 193 may be formed of peelable layers.

At least some of the subject matter described herein may be implemented in digital electronic circuitry, in computer software, firmware, hardware, or in combinations of them. For example, controllers to control the application of adhesive to the substrate (e.g., by way of a digital printer), the placement of topping materials on the substrate-adhesive structure, etc., may be implemented using processor-based devices, digital electronic circuitry, etc. The subject matter described herein can be implemented as one or more computer program products, i.e., one or more computer programs tangibly embodied in non-transitory media, e.g., in a machine-readable storage device, for execution by, or to control the operation of, data processing apparatus, e.g., a programmable processor, a computer, or multiple computers. A computer program (also known as a program, software, software application, or code) can be written in any form of programming language, including compiled or interpreted languages, and it can be deployed in any form, including as a stand-alone program or as a module, component, subroutine, or other unit suitable for use in a computing environment. A computer program does not necessarily correspond to a file. A program can be stored in a portion of a file that holds other programs or data, in a single file dedicated to the program in question, or in multiple coordinated files (e.g., files that store one or more modules, sub-programs, or portions of code). A computer program can be deployed to be executed on one computer or on multiple computers at one site or distributed across multiple sites and interconnected by a communication network.

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. Media suitable for embodying computer program instructions and data include all forms of volatile (e.g., random access memory) or non-volatile memory, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

At least some of the subject matter described herein may be implemented in a computing system that includes a back-end component (e.g., a data server), a middleware component (e.g., an application server), or a front-end component (e.g., a client computer having a graphical user interface or a web browser through which a user can interact with an implementation of the subject matter described herein), or any combination of such back-end, middleware, and front-end components. The components of the system can be interconnected by any form or medium of digital data communication, e.g., a communication network. Examples of communication networks include a local area network ("LAN") and a wide area network ("WAN"), e.g., the Internet.

The computing system may include clients and servers. A client and server are generally remote from each other in a logical sense and typically interact through a communication network. The relationship of client and server may arise by virtue of computer programs running on the respective computers and having a client-server relationship to each other.

A number of embodiments have been described. Nevertheless, it will be understood that various modifications may be made without departing from the spirit and scope of the invention. Accordingly, other embodiments are within the scope of the following claims.

What is claimed is:

1. A system comprising:

an adhesive depositing machine configured to deposit a curable adhesive onto a first surface of a substrate in a pre-determined pattern;

a placement device configured to place topping material onto the substrate with the deposited adhesive, said placement device comprises a funnel shaped receptacle configured to receive and dispense topping material, said receptacle comprising slanted outer walls and an inner perforated partition spanning the height of the receptacle, wherein said receptacle and said partition are configured to vibrate in different frequencies, whereby the topping material is shattered between said receptacle walls and said partition;

an ultraviolet (UV) energy source configured to apply UV energy to the substrate including the deposited adhesive and the placed topping material to cause curing of the deposited adhesive; and a topping material removal unit configured to remove excess topping material not adhered to the deposited adhesive, said removal unit comprising:

a plurality of wheels mounted on a shaft, each wheel comprising needles attached to its circumference, said wheels configured to collect excess topping material from the substrate;

a brush spanning the wheels shaft and configured to brush topping material from the needles; and a vacuum system mounted above said wheels, said vacuum system configured to suck topping material from said needles and transfer it to said placement device.

2. A system comprising:

an adhesive depositing machine configured to deposit a curable adhesive onto a first surface of a substrate in a pre-determined pattern;

a placement device configured to place topping material onto the substrate with the deposited adhesive;

an ultraviolet (UV) energy source configured to apply UV energy to the substrate including the deposited adhesive and the placed topping material to cause curing of the deposited adhesive; and a topping material removal unit configured to remove excess topping material not adhered to the deposited adhesive, said removal unit comprising:

a plurality of wheels mounted on a shaft, each wheel comprising needles attached to its circumference, said wheels configured to collect excess topping material from the substrate;

a brush spanning the wheels shaft and configured to brush topping material from the needles; and a vacuum system mounted above said wheels, said vacuum system configured to suck topping material from said needles and transfer it to said placement device, wherein the system further comprises a cleaning station downstream said vacuum system, said cleaning station configured to remove non-adhered topping material from the substrate, said cleaning station comprising:

a first wheel mounted underneath the substrate and configured to rotate in a first direction coinciding with the direction of movement of the substrate;

a second wheel mounted above the substrate and configured to rotate in a direction opposite said first direction, said second wheel having a sticky surface configured to collect residual topping material from said substrate; and a third wheel mounted above said second wheel and configured to rotate in said first direction, said third wheel having a surface stickier than said second wheel surface and configured to collect topping material from said second wheel surface, wherein said third wheel surface is peelable.

* * * * *